US008743037B2

(12) United States Patent
Masumura

(10) Patent No.: US 8,743,037 B2
(45) Date of Patent: Jun. 3, 2014

(54) LIQUID CRYSTAL DISPLAY DEVICE AND METHOD OF DRIVING SAME

(75) Inventor: Kazunori Masumura, Kanagawa (JP)

(73) Assignee: NLT Technologies, Ltd., Kanagawa (JP)

( * ) Notice: Subject to any disclaimer, the term of this patent is extended or adjusted under 35 U.S.C. 154(b) by 1079 days.

(21) Appl. No.: 12/264,359

(22) Filed: Nov. 4, 2008

(65) Prior Publication Data

US 2009/0121993 A1 May 14, 2009

(30) Foreign Application Priority Data

Nov. 14, 2007 (JP) ..... 2007-295732

(51) Int. Cl.
*G09G 3/36* (2006.01)

(52) U.S. Cl.
USPC ..... 345/88; 345/30; 345/82; 345/87; 345/89; 345/96

(58) Field of Classification Search
None
See application file for complete search history.

(56) References Cited

U.S. PATENT DOCUMENTS

| | | | | |
|---|---|---|---|---|
| 6,803,894 | B1 * | 10/2004 | Hirota et al. | 345/88 |
| 2005/0062703 | A1 * | 3/2005 | Lee et al. | 345/89 |
| 2006/0125748 | A1 * | 6/2006 | Yang et al. | 345/88 |
| 2007/0070009 | A1 | 3/2007 | Mori et al. | |
| 2007/0146279 | A1 | 6/2007 | Oke et al. | |
| 2007/0159425 | A1 * | 7/2007 | Knepper et al. | 345/87 |

FOREIGN PATENT DOCUMENTS

| | | |
|---|---|---|
| JP | 2001-255506 | 9/2001 |
| JP | 2004-045741 | 2/2004 |
| JP | 2006-301563 | 11/2006 |
| JP | 2007-093660 | 4/2007 |
| JP | 2007-094008 | 4/2007 |

OTHER PUBLICATIONS

JP Office Action dated Jan. 29, 2013, Application No. 2007-295732.

* cited by examiner

*Primary Examiner* — Jesus Hernandez
(74) *Attorney, Agent, or Firm* — Young & Thompson

(57) ABSTRACT

A color field-sequential liquid crystal display device comprising: a liquid crystal panel; a planar light-source unit for emitting light toward the liquid crystal panel; and a signal processor connected to the liquid crystal panel and to the planar light-source unit; wherein the signal processing includes: a comparing unit that compares video signals included in subframes of at least one identical color in each frame of two mutually adjacent video frames; and a polarity reversing unit that reverses the polarities of video signals in mutually adjacent subframes within the same frame, deciding whether or not to reverse the polarities of all video signals of one frame based upon the result of the comparison by the comparing unit, and outputting a video signal having the decided polarity to the liquid crystal panel.

5 Claims, 13 Drawing Sheets

COMPARATIVE

LIQUID CRYSTAL DISPLAY DEVICE AND METHOD OF DRIVING SAME

REFERENCE TO RELATED APPLICATION

This application is based upon and claims the benefit of the priority of Japanese patent application No. 2007-295732, filed on Nov. 14, 2007, the disclosure of which is incorporated herein in its entirety by reference thereto.

TECHNICAL FIELD

This invention relates to a liquid crystal display device and to a method for driving the same. More particularly, the invention relates to a color field-sequential liquid crystal display device and to a method for driving this device.

BACKGROUND

Methods for colorizing a display device mainly employ a method based upon spatial division and a method based upon time division. Further, there are also display devices that use a combination of both of these methods. Examples of colorization using spatial division are a delta-shaped spatial array of phosphors of a plurality of colors in a CRT and a spatial array of color filters in a liquid crystal display. Colorization using time division usually is referred to as a "color field sequential technology". With a color field sequential method, a color display is realized not by dividing one pixel spatially but by varying color displayed on a time-wise basis.

Since the color field sequential method does not divide pixels spatially, it excels in terms of aperture ratio and readily lends itself to microfabrication. In addition, since the necessary number of wiring traces is small, the scale of the driving circuit can be reduced and packaging facilitated. In particular, in a case where color conversion efficiency is not high in spatial color generation, e.g., in a case where the amount of absorption of light is large, which is a result when a liquid crystal display uses color filters, using the color field sequential method makes it possible to raise the efficiency of utilization of light and reduces power consumption.

An example of a liquid crystal display device that employs the color field sequential method is disclosed in Patent Document 1. This liquid crystal display device has a display unit and a driving unit, in which the color of a monochromatic image displayed is any one of the three primary colors, and the driving unit causes a monochromatic image to be displayed on the display unit in accordance with a periodic array in which an array of even-numbered monochromatic images is adopted as one unit. FIG. 13 illustrates the relationship between driving voltage and time. Time is plotted along the horizontal axis and voltage along the vertical axis. Voltage is applied in the order of the colors R, G, B, G in one frame 102. By adopting such an arrangement, the colors R, G, B always repeat at the same polarity. As a result, even in a case where a DC voltage component VDC has been superimposed upon the voltage waveform, as illustrated in FIG. 13, the influence of VDC always appears equally in any frame and it is possible to greatly reduce the difference between absolute values of driving voltage produced by a voltage polarity reversal in every frame interval. This makes it possible to obtain a flicker-free high-quality display.

As related art, Patent Document 2 describes an electro-optic device that makes it possible to increase the number of expressible gray levels and improve response in a case where a display is presented using an electro-optic substance having a slow optical response, as in the case of liquid crystal.

[Patent Document 1]
JP Patent Kokai Publication No. JP-P2001-255506A
[Patent Document 2]
JP Patent Kokai Publication No. JP-P2006-301563A

SUMMARY OF THE DISCLOSURE

The entire disclosures of the above mentioned documents are incorporated herein by reference thereto.

The analysis set forth below is given in the present invention.

In accordance with the prior art of Patent Document 1, the polarities of voltages in monochromatic images of the same color are always the same, thereby enabling a large reduction in the difference between absolute values of driving voltage produced by a reversal of voltage polarity. However, since the polarities of voltages in monochromatic images of the same color are always the same, a DC component tends to become superimposed upon the video signal, which is written to the pixels, owing to a slight computational error. When the DC component is superimposed, the liquid crystal can no longer be subjected to AC drive. Hence there is the danger of liquid crystal burn-in.

Accordingly, it is an object of the present invention to provide a liquid crystal display device that is free of flicker and burn-in as well as a method for driving this device.

According to a first aspect of the present invention, there is provided a liquid crystal display device comprising a liquid crystal panel, a planar light-source unit for emitting light toward the liquid crystal panel and a signal processor connected to the liquid crystal panel and planar light-source unit. The signal processing includes: a comparing unit that compares video signals included in subframes of at least one identical color in each frame of two mutually adjacent video frames; and a polarity reversing unit that mutually reverses the polarities of video signals in mutually adjacent subframes within the same frame, deciding whether or not to reverse the polarities of all video signals of one frame based upon the result of the comparison by the comparing unit, and outputting a video signal having the decided polarity to the liquid crystal panel.

In the liquid crystal display device of the present invention, the comparing unit determines whether a difference in gray levels between gray-level signals of video signals located at the same time or spatial position from the beginning of the subframe among the subframes of the same color is not less than a prescribed value, and the polarity reversing unit reverses the polarities of all video signals of one frame and outputs the result in a case where the difference in gray levels is not less than the prescribed value, and outputs all of the video signals of the one frame as is in a case where the difference in gray levels is less than the prescribed value.

In the liquid crystal display device of the present invention, the video signals compared by the comparing unit may be signals corresponding to a prescribed plurality of pixels in the liquid crystal panel.

According to another aspect of the present invention, there is provided a method for driving a color field-sequential liquid crystal display device having a liquid crystal panel, a planar light-source unit for emitting light toward the liquid crystal panel and a signal processor connected to the liquid crystal panel and planar light-source unit. The method comprises: reversing the polarities of video signals between mutually adjacent subframes in the same video frame; comparing video signals corresponding to a prescribed one or a plurality of pixels of the liquid crystal display panel between subframes of the same color in two mutually adjacent video frames, thereby detecting a change in the video signals in the prescribed one or plurality of pixels between subframes; deciding whether or not to reverse the polarities of all video signals of one frame based upon the result of detection; and outputting a video signal having the decided polarity to the liquid crystal panel.

In the method for driving a liquid crystal display device according to the present invention, deciding whether or not to reverse polarity may include reversing the polarities of all video signals of the one frame and outputting the result in a case where the result of detection indicates a change that is not less than a prescribed amount, and outputting all of the video signals of the one frame as is in a case where the difference in result of detection indicates a change that is less than the prescribed amount.

In accordance with such a liquid crystal display device and method for driving the same, the signals between mutually adjacent subframes within the same frame may be reversed and output, thereby reversing the polarity of a sequential analog video signal, which is written to a liquid crystal panel, unconditionally in mutually adjacent subframe units into which the frame has been divided, thus enabling burn-in to be prevented.

Further, the signals in subframes corresponding to the same color are compared in each frame of a mutually adjacent first frame and second frame, and the polarity impressed upon a liquid crystal panel can be selected. Accordingly, the reversal or non-reversal of the polarity of a sequential analog video signal can be selected in units of mutually adjacent frames, and prevention of burn-in or reduction of flicker can be set as necessary. That is, if a change in the video signal is not detected between subframes of the same color between mutually adjacent frames, the polarity is made the same and flicker due to a change in polarity can be prevented. Further, if there is a change in the video signal between subframes of the same color, the polarity is reversed. As a result, if observed over an extended period of time, DC components are cancelled out and burn-in of the display device can be prevented.

The meritorious effects of the present invention are summarized as follows.

In accordance with the present invention, whether or not the polarity of a signal applied to a liquid crystal panel is reversed can be determined by comparing video signals included in subframes of the same color in two mutually adjacent video frames. This makes it possible to prevent burn-in and to present a display exhibiting almost no flicker.

Other features and advantages of the present invention will be apparent from the following description taken in conjunction with the accompanying drawings, in which like reference characters designate the same or similar parts throughout the figures thereof.

PREFERRED MODES OF THE INVENTION

Preferred exemplary embodiments of the present invention will now be described in detail with reference to the drawings.

[First Exemplary Embodiment]

Figure 1:
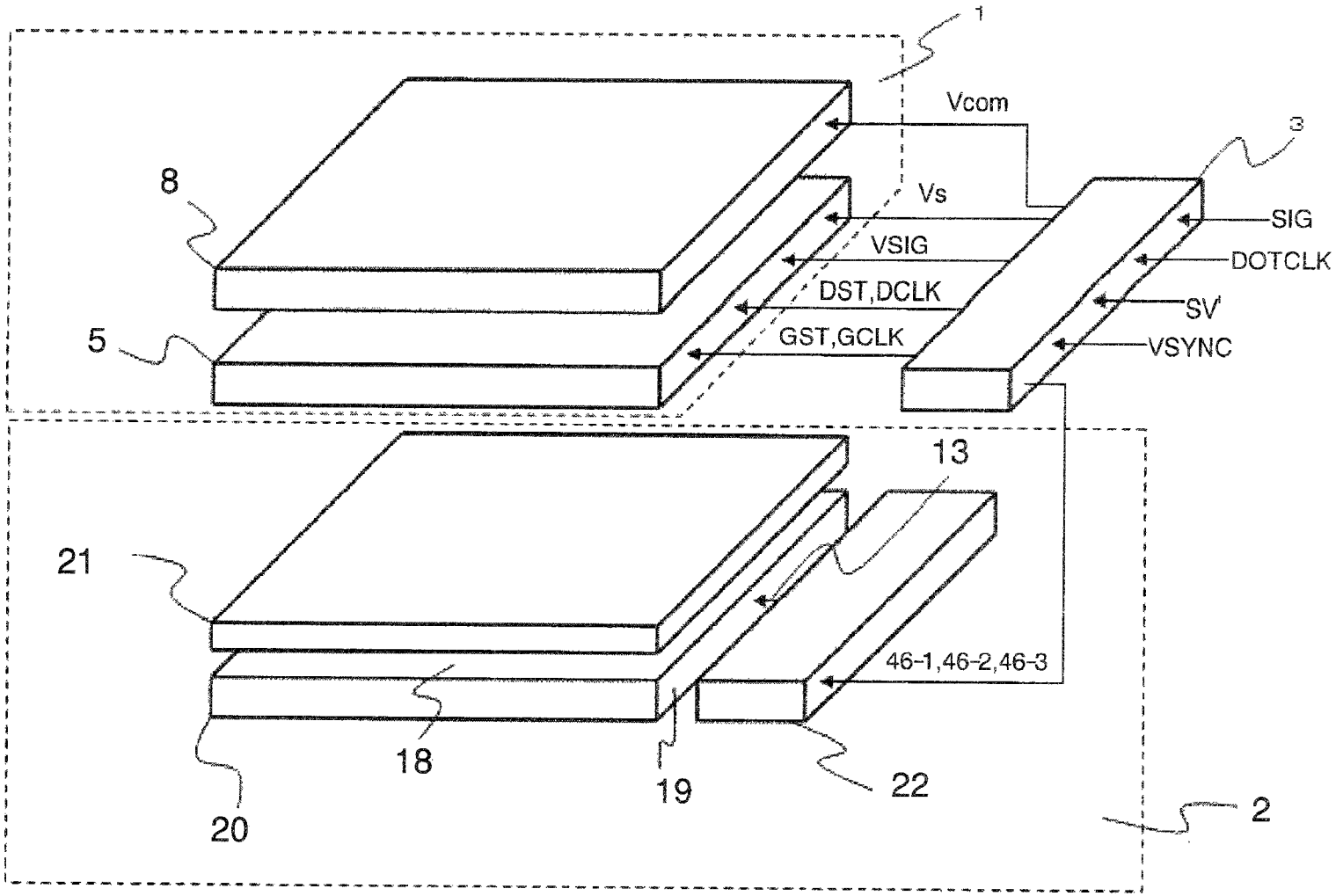
FIG. 1 is a diagram illustrating the configuration of a liquid crystal display device according to a first exemplary embodiment of the present invention.

FIG. 1 is a diagram illustrating a configuration of a liquid crystal display device according to a first exemplary embodiment of the present invention. The liquid crystal display device according to the present invention is a color field-sequential liquid crystal display device having a liquid crystal panel, a planar light-source unit that emits light toward the liquid crystal panel and a signal processor connected to the liquid crystal panel and planar light-source unit. More specifically, as shown in FIG. 1, the liquid crystal display device includes a liquid crystal panel 1 having one surface for displaying video; a backlight 2 serving as a planar light source disposed on the non-display side of the liquid crystal panel 1, namely on the other surface thereof; and a signal processor 3 for supplying the liquid crystal panel 1 and backlight 2 with signals.

Figure 2:
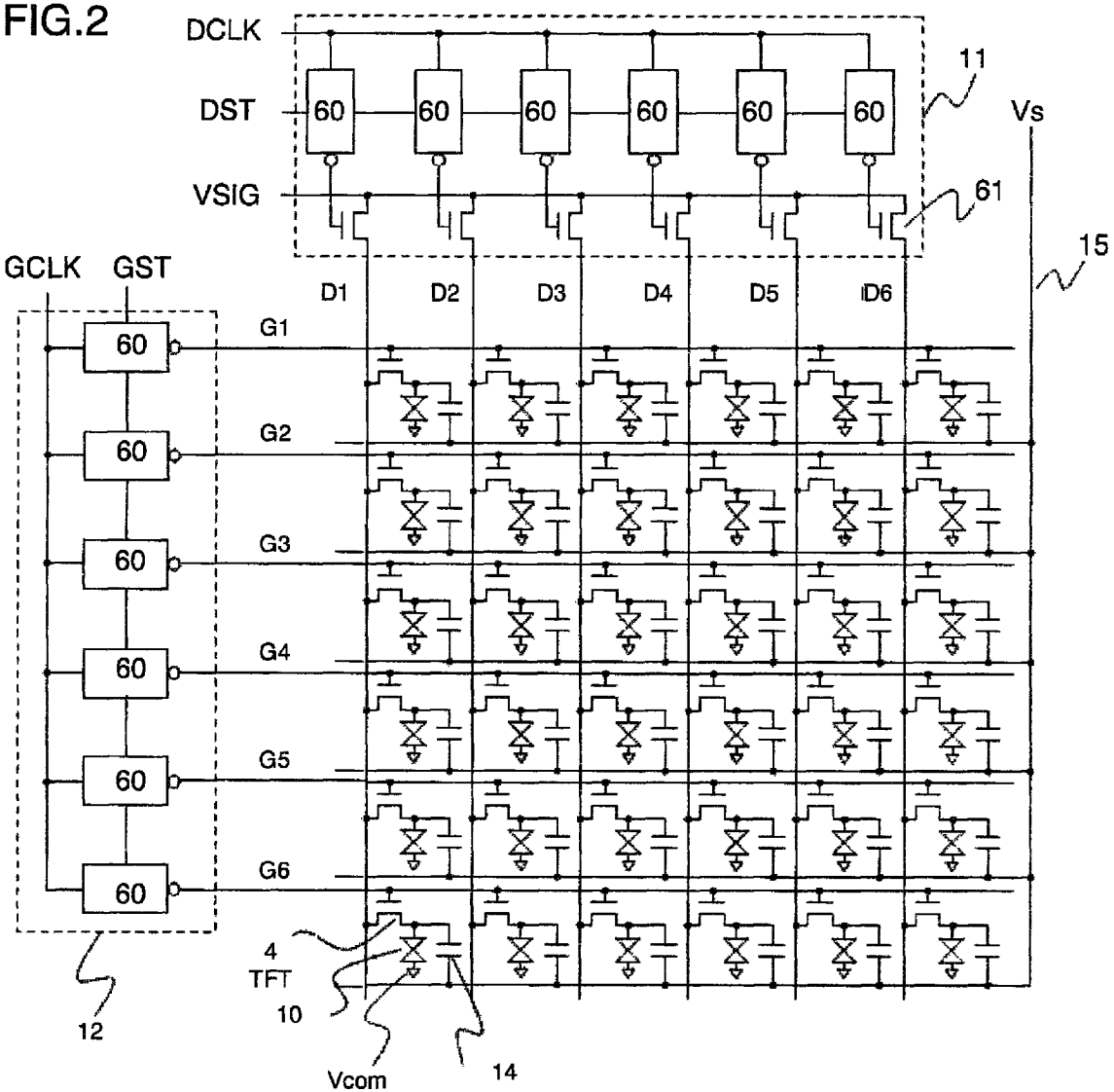
FIG. 2 is a circuit diagram of a circuit on one transparent substrate.

The liquid crystal panel 1 comprises transparent substrates 5 and 8. As illustrated in FIG. 2, the transparent substrate 5 employs TFTs 4 as active elements. Pixels each comprising a transparent pixel electrode (not shown) and an auxiliary capacitor 14 and connected to a TFT are arrayed in matrix form in a plurality of rows and columns. The liquid crystal panel 1 is provided with a plurality of gate wiring traces G1, G2, G3, G4, G5, G6 for supplying gate signals to the TFTs 4 of respective rows; a plurality of data wiring traces D1, D2, D3, D4, D5, D6 for supplying a sequential analog video signal VSIG to the TFTs of respective columns; and an auxiliary capacitor line 15 for connecting the auxiliary capacitors 14 to an auxiliary capacitor potential Vs. The other transparent substrate 8, which is bonded to the transparent substrate 5 via a frame-shaped sealing member, has a film-like transparent opposing electrode (not shown) disposed on the non-display side, and an opposing-electrode wire (not shown) connecting the opposing electrode to an opposing potential Vcom is provided. A liquid crystal layer 10 is provided between the transparent substrates 5, 8 in the space delimited by frame-shaped sealing member. The data wiring traces D1, D2, D3, D4, D5, D6 of the respective columns are connected to the sources of the TFTs 4 in each row and column, the gate wiring traces G1, G2, G3, G4, G5, G6 of the respective rows are connected to the gates of the TFTs 4 in each row and column, and the transparent pixel electrodes and auxiliary capacitors 14 are connected to the drains of the TFTs 4.

The liquid crystal panel 1 further has a data driver 11 at one edge of the transparent substrate 5 along the row direction thereof, and a gate driver 12 at one edge of the transparent substrate 5 along the column direction thereof. The data driver 11 is composed of six shift registers 60 and the same number of analog switches 61. Outputs of the serially connected shift registers 60 are connected to the gates of the analog switches in one-to-one correspondence, the plurality of data wiring traces D1, D2, D3, D4, D5, D6 are connected to the sources of the respective analog switches in one-to-one correspondence, and the sequential analog video signal VSIG is supplied to the drains of the analog switches. The gate driver 12 is composed of six serially connected shift registers 60. The plurality of gate wiring traces G1, G2, G3, G4, G5, G6 are connected to the outputs of respective ones of the serially connected shift registers 60 in one-to-one correspondence. It should be noted that although the pixels in the drawing are illustrated as a matrix array of six rows and six columns, this is for the purpose of simplifying the illustration and does not in any way impose a limitation upon the number of pixels.

The backlight 2 includes an emergent-light surface 18 having an area the same as or larger than the overall display area of the liquid crystal panel 1 on which the plurality of pixels are arrayed in matrix form; an incident-light surface 19 upon which light 13 is incident from a surface different from the emergent-light surface 18, e.g., from directly below or from a portion of the side surface; light-guide unit 20 for guiding the light 13, which has entered from the incident-light surface 19, to the emergent-light surface 18; diffusing unit 21 for causing the light 13 to diffuse evenly from the light-guide unit 20 toward the emergent-light surface 18; and light-emitting unit 22 for supplying the incident-light surface 19 with the light 13 of the three colors R (red), green (G) and blue (B).

A video signal SIG, a subframe vertical synchronizing signal SV, a vertical synchronizing signal VSYNC in which one period indicates the time period of one frame and a dot clock signal DOTCLK in which one period indicates the time period of one pixel are externally input to the signal processor 3. On the basis of a change in the intensity of the video signal that is written to a predetermined pixel a of the liquid crystal panel 1, the signal processor 3 decides the polarity of the video signal to be written to a pixel and outputs the resultant video signal to the transparent substrate 5 as the sequential analog video signal VSIG. Further, a data driver clock DCLK and a data driver start signal DST to the shift registers 60 of the data driver 11, and a gate driver clock signal GCLK and gate driver start signal GST to the shift registers 60 of the gate driver 12 are output to the transparent substrate 5. Furthermore, the auxiliary capacitor potential Vs is supplied to the transparent substrate 5 and the opposing potential Vcom is supplied to the transparent substrate 8.

Figure 3:
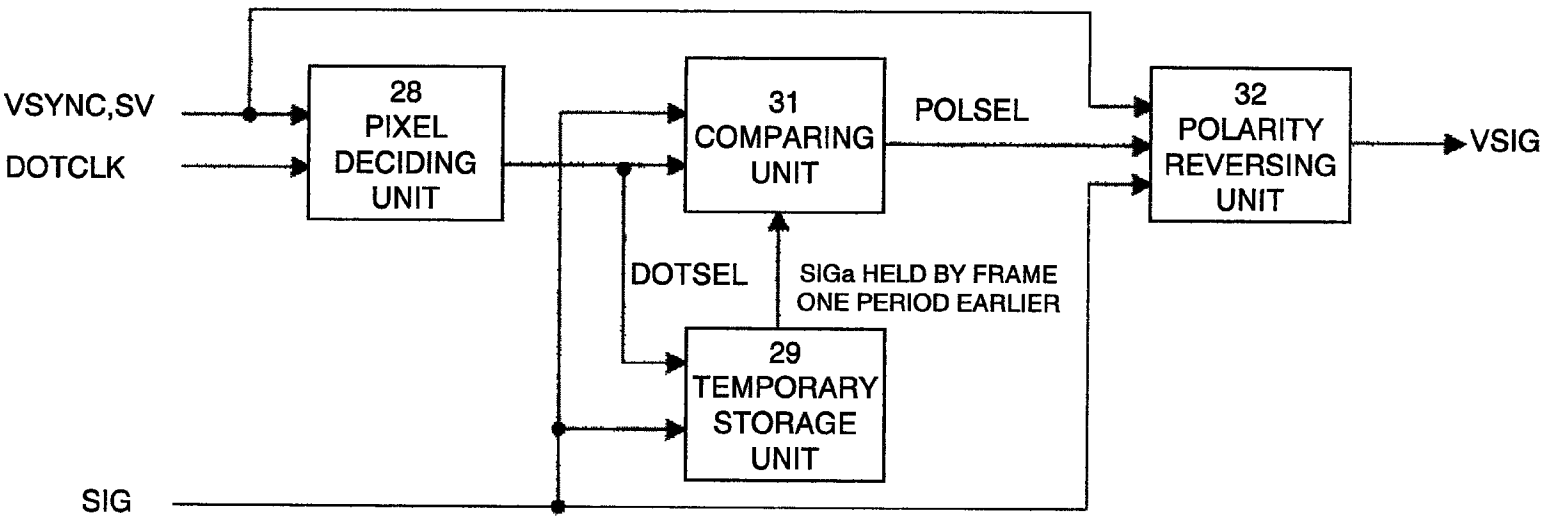
FIG. 3 is a block diagram illustrating the main portion of a signal processor according to the first exemplary embodiment.

FIG. 3 is a block diagram illustrating the main portion of the signal processor 3 according to the first exemplary embodiment. The signal processor 3 includes a pixel deciding unit 28, a temporary storage unit 29, a comparing unit 31 and a polarity reversing unit 32.

The pixel deciding unit 28 selects the video signal SIG that corresponds to the sequential analog video signal VSIG written to any pixel a of the liquid crystal panel 1

The temporary storage unit 29 stores a video signal SIGa corresponding to the sequential analog video signal VSIG written to the pixel a of the liquid crystal panel 1 decided by the pixel deciding unit 28.

The comparing unit 31 compares the video signal SIGa that has been stored in the temporary storage unit 29 and the video signal SIG corresponding to the sequential analog video signal VSIG written to the pixel a of the liquid crystal panel 1 selected by the pixel deciding unit 28 and, based upon the result of the comparison, generates a polarity selection signal POLSEL that selects the polarity of the sequential analog video signal VSIG. The comparison relates to whether or not the difference between the two signals is not less than a prescribed value. In the example set forth below, the prescribed value is 1. That is, the description will be rendered based upon whether or not the comparison indicates coincidence.

The polarity reversing unit 32 reverses the polarity of the sequential analog video signal VSIG based upon the polarity selection signal POLSEL generated by the comparing unit 31.

Although these components are not illustrated in FIG. 3, the signal processor 3 includes a timing controller for supplying the signals DST, DCLK, GST and GCLK that control the gate driver 12 and data driver 11 of the liquid crystal panel 1; a power supply for supplying the transparent substrate 8 with the opposing potential Vcom and the auxiliary capacitor line 15 with the auxiliary capacitor potential Vs; and a power supply for supplying the light-emitting unit 22 of the backlight 2 with the potential necessary for drive.

The details of the pixel deciding unit 28 and the comparing unit 31 will be described next.

Figure 4:
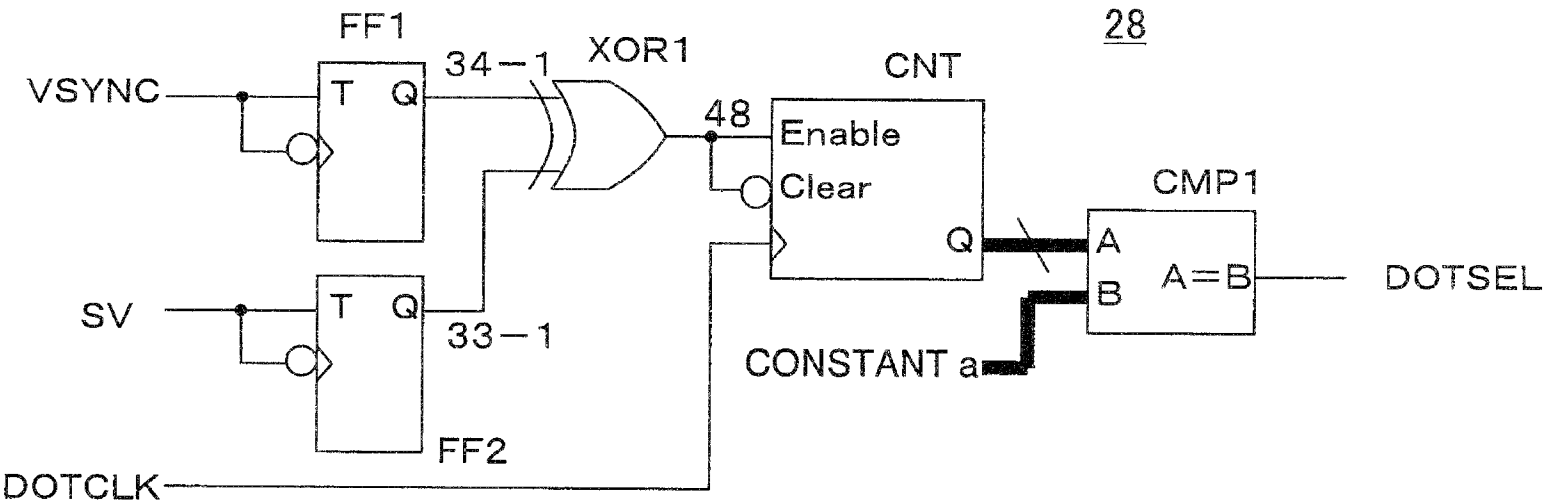
FIG. 4 is a circuit diagram of pixel deciding unit according to the first exemplary embodiment.

FIG. 4 is a circuit diagram of the pixel deciding unit 28. As shown in FIG. 4, the pixel deciding unit 28 includes flip-flops FF1, FF2, an exclusive-OR gate XOR1, a counting circuit CNT and a comparing circuit CMP1. The flip-flop FF1 receives the vertical synchronizing signal VSYNC as an input and outputs a signal 34-1 that switches between high and low every period of a frame. Further, the flip-flop FF2 receives the subframe vertical synchronizing signal SV as an input and outputs a signal 33-1 that switches between high and low every period of a subframe. The exclusive-OR gate XOR1 computes the exclusive-OR between the signals 34-1 and 33-1, generates a signal 48 that attains the high level only in the time period of the G (green) subframe in all frames and outputs the signal 48. The counting circuit CNT initializes the count value in the time periods when the signal 48 is low, counts the signal DOTCLK only in the time periods in which the signal 48 is high and outputs the count. The comparing circuit CMP1 compares the count value in the counting circuit CNT and the value of a constant a, which is a count value, from the results of counting, indicative of a video signal SIG corresponding to the specific pixel. The comparing circuit CMP1 outputs a pixel selection signal DOTSEL which goes high only in time periods in which the two values coincide and goes low if the two signals do not coincide. That is, the comparing circuit CMP1 generates the pixel selection signal DOTSEL that goes high only in the time period of the video signal SIG corresponding to the specific pixel. This pixel selection signal DOTSEL is a signal that selects, from the video signal SIG, the video signal SIG corresponding to VSIGa, which is the sequential analog video signal written to the specific pixel a.

Figure 5:
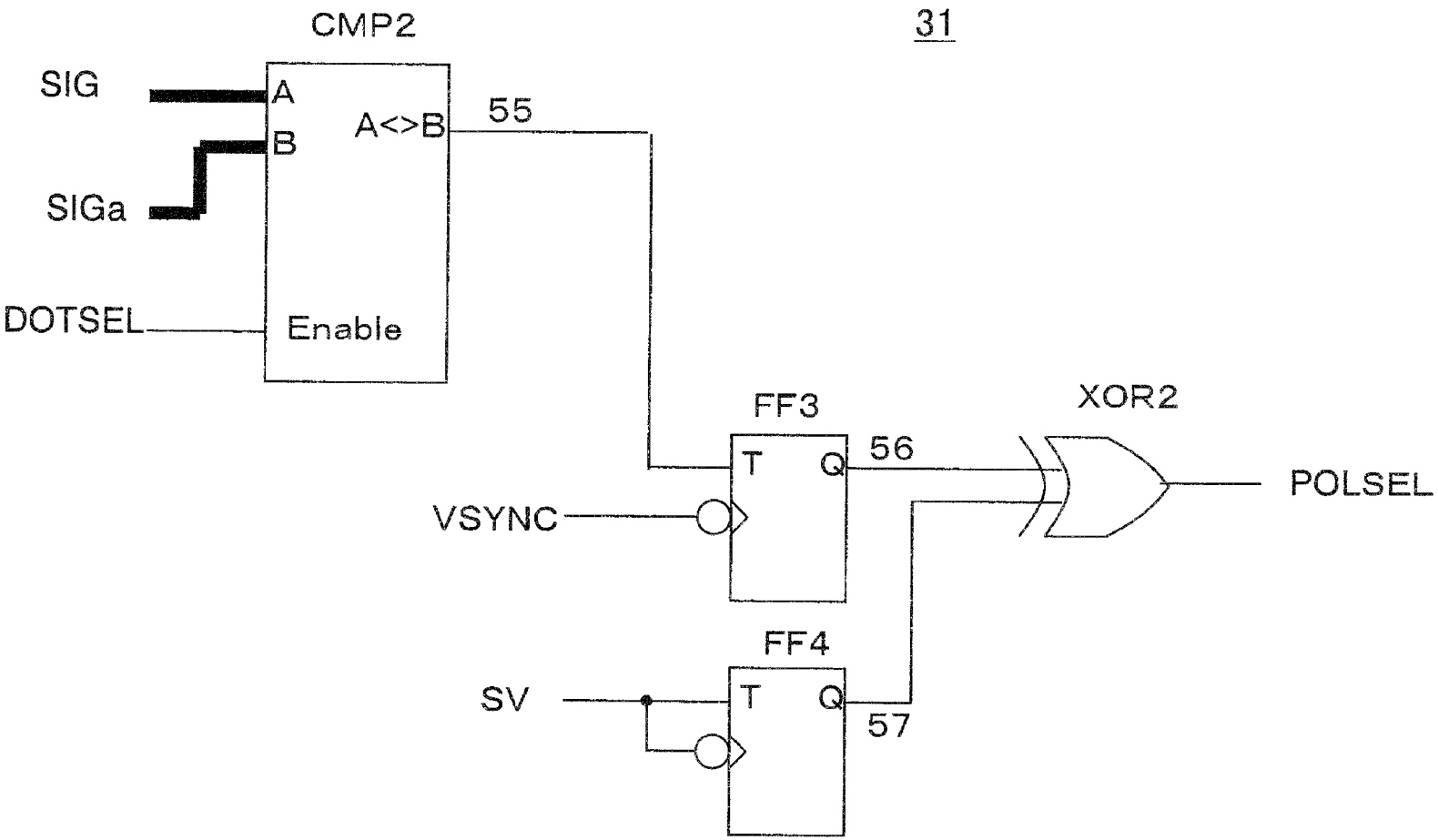
FIG. 5 is a circuit diagram of comparing unit according to the first exemplary embodiment.

FIG. 5 is a circuit diagram of the comparing unit 31. As illustrated in FIG. 5, the comparing unit 31 includes a comparing circuit CMP2, flip-flops FF3, FF4 and an exclusive-OR gate XOR2. The comparing circuit CMP2 compares the video signal SIG and the video signal SIGa, which has been output from the temporary storage unit 29, only in time periods in which the pixel selection signal DOTSEL is high, generates a comparison-result signal 55 which goes high when the intensities of both signals are different and goes low if the two intensities are the same, and outputs the signal 55. The flip-flop FF3 holds the comparison-result signal 55 in synch with the vertical synchronizing signal VSYNC and outputs it as a signal 56. The flip-flop FF4 receives the subframe vertical synchronizing signal SV as an input and outputs a signal 57 that switches between high and low unconditionally every period of a subframe. The exclusive-OR gate XOR2 computes the exclusive-OR between the signals 56 and 57 and outputs the polarity selection signal POLSEL which, when the result of the exclusive-OR operation is high, selects the positive polarity for the polarity of the sequential analog video signal VSIG and, when the result of the exclusive-OR operation is low, selects the negative polarity for the polarity of the sequential analog video signal VSIG. The polarity selection signal POLSEL is output to the polarity reversing unit 32 and is a signal which, when high, selects the positive polarity for the polarity of the sequential analog video signal VSIG and, when low, selects the negative polarity for the polarity of the sequential analog video signal VSIG.

The selection based upon the polarity selection signal POLSEL involves comparing, between mutually adjacent frames, the intensity of the video signal SIG corresponding to the specific pixel a. If there is no change in intensity, then the selection made is to reverse polarity between mutually adjacent subframes within the frames and to not reverse polarity between mutually adjacent frames. It there is a change in intensity, then the selection made is to reverse polarity both between mutually adjacent frames and between mutually adjacent subframes within the frames.

Figure 6:
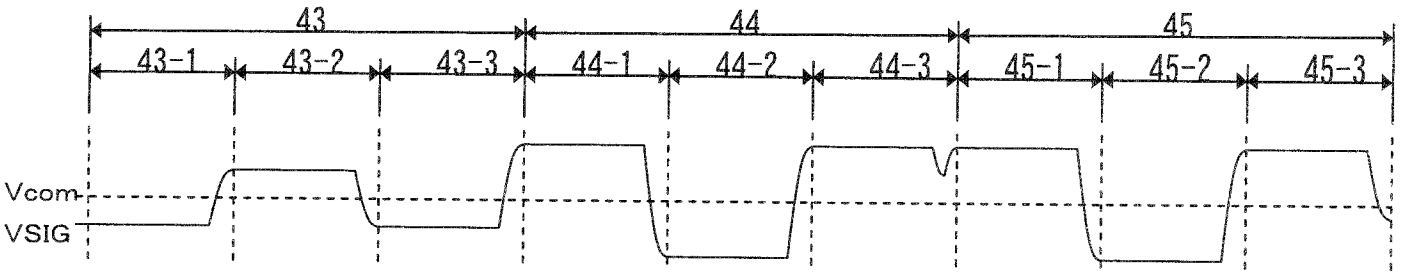
FIG. 6 is a timing chart representing operation of the liquid crystal display device according to the first exemplary embodiment.

A timing chart relating to each of the components of the liquid crystal display device will be described next. FIG. 6 is a timing chart representing operation of the liquid crystal display device according to the first exemplary embodiment of the present invention. FIG. 6 illustrates a case where one frame has been divided into three subframes for displaying monochromatic video of the colors R (red), G (green) and B (blue). Reference numerals 43, 44 and 45 denote frames in FIG. 6. Specifically, reference numeral 43 denotes a frame at a certain time n, 44 a frame corresponding to a time n+1 for displaying color video following frame 43, and 45 a frame corresponding to a time n+2 for displaying color video following frame 44. In frame 43, subframes 43-1, 43-2, 43-3 corresponding to R (red), G (green), B (blue), respectively, are arrayed along the time axis. Similarly, subframes 44-1, 44-2, 44-3 corresponding to R (red), G (green), B (blue), respectively, are arrayed in frame 44, and subframes 45-1, 45-2, 45-3 corresponding to R (red), G (green), B (blue), respectively, are arrayed in frame 45.

In the subframes arrayed within each of the frames, the sequential analog video signal VSIG in mutually adjacent subframes undergoes a polarity reversal about the opposing potential Vcom. For example, in frame 43, the sequential analog video signal VSIG has negative polarity with respect to opposing potential Vcom in subframe 43-1, positive polarity with respect to opposing potential Vcom in subframe 43-2 and negative polarity with respect to opposing potential Vcom in subframe 43-3. Further, in frame 44, the polarity of the sequential analog video signal VSIG is the opposite of that in frame 43 on a subframe-by-subframe basis. That is, the sequential analog video signal VSIG has positive polarity with respect to opposing potential Vcom in subframe 44-1, negative polarity with respect to opposing potential Vcom in subframe 44-2 and positive polarity with respect to opposing potential Vcom in subframe 44-3. In frame 45, however, the polarities of the sequential analog video signal VSIG are the same as those in frame 44; this is different from the reversed relationship between frames 43 and 44. That is, the sequential analog video signal VSIG has positive polarity with respect to opposing potential Vcom in subframe 45-1, negative polarity with respect to opposing potential Vcom in subframe 45-2 and positive polarity with respect to opposing potential Vcom in subframe 45-3.

Thus, as for the sequence for selecting the polarity of the sequential analog video signal VSIG, the polarity of the sequential analog video signal VSIG is reversed unconditionally in units of mutually adjacent subframes within a frame. Furthermore, the polarity of the sequential analog video signal VSIG is selectively reversed or not reversed in units of mutually adjacent frames. This operation is performed with respect to all frames to thereby drive the liquid crystal display device.

Figure 7:
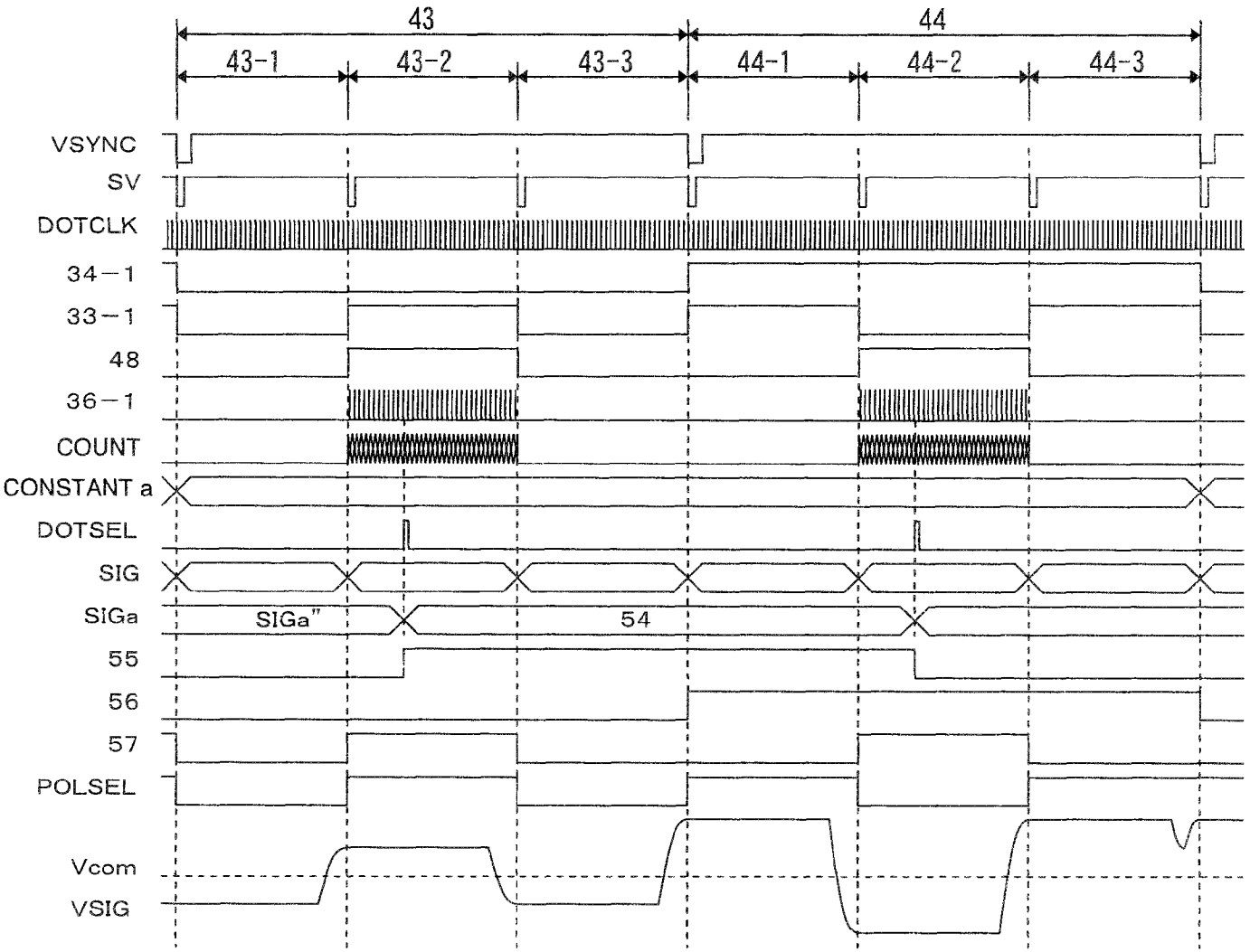
FIG. 7 is a timing chart representing operation of a signal processor according to the first exemplary embodiment.

Next, the operation of the signal processor 3 for implementing the driving method shown in FIG. 6 will be described with reference to FIG. 7. FIG. 7 illustrates the drive timing of the signal processor 3 over two frames 43, 44. Frame 43 is constituted by the subframes 43-1, 43-2, 43-3 of the colors R (red), G (green), B (blue), respectively, along the time axis. Similarly, frame 44 is constituted by the subframes 44-1, 44-2, 44-3 of the colors R, G, B, respectively, along the time axis.

In FIG. 7, the video signal SIG, the vertical synchronizing signal VSYNC indicating the frame time period, the subframe vertical synchronizing signal SV indicating the subframe time period and the dot clock signal DOTCLK in which one period indicates the time period of one pixel are signals supplied to the signal processor 3 externally.

The signal 34-1 that switches between the high and low levels every period of a frame and the signal 33-1 that switches between the high and low levels every period of a subframe are generated by the vertical synchronizing signal VSYNC and subframe vertical synchronizing signal SV. The signal 48, which attains the high level only in the time period of the G (green) subframe in all frames, is generated by computing the exclusive-OR between the signals 34-1 and 33-1.

The count value is initialized in the time periods when the signal 48 is at the low level, and the dot clock signal DOTCLK is counted only in the time periods in which the signal 48 is at the high level. The count value and the value of the constant a, which is obtained by holding the count value indicating the video signal SIG corresponding to the specific pixel a, are compared. The pixel selection signal DOTSEL, which attains the high level only in time periods in which the two values coincide and assumes the low level if the two signals do not coincide, is generated. That is, the pixel selection signal DOTSEL attains the high level only in the time period of the video signal SIG corresponding to the specific pixel a.

The video signal SIG corresponding to the sequential analog video signal VSIG (VSIGa) written to the specific pixel a of the G (green) subframe is selected at the rising edge of the pixel selection signal DOTSEL in all frames. The video signal SIG selected is held as the video signal SIGa. For example, in FIG. 7, a video signal SIGa" that was held in the frame time period (not shown) one frame earlier than frame 43 is held as video signal SIGa until the timing at which the pixel selection signal DOTSEL in the time period of frame 43 attains the high level. Further, the video signal SIG input at the timing at which the pixel selection signal DOTSEL attains the high level is held as the video signal SIGa (54) in the time period of frame 43.

In this exemplary embodiment, it is assumed that the specific pixel a lies in the G (green) subframe. However, this is for the purpose of simplifying the description. The specific pixel may just as well fall within the R (red) and B (blue) subframes, as will be described later. In addition, there may be a plurality of specific pixels.

The comparison-result signal 55 is output based upon whether or not there is a change in intensity between the held video signal SIGa and the video signal SIG that has been selected by the pixel selection signal DOTSEL. For example, in the time period of frame 43, the comparison-result signal 55 is produced by comparing the selected video signal SIG and the entered video signal SIGa" that is output from the temporary storage unit 29, and changes from the low to the high level at the timing at which the pixel selection signal DOTSEL in the time period of frame 43 attains the high level. At the timing at which the pixel selection signal DOTSEL in the time period of frame 43 attains the high level, the temporary storage unit 29 stores the entered video signal SIG of frame 43 as the signal SIGa and, at the same time, outputs the signal SIGa", which was stored in the immediately preceding frame, to the comparing unit 31. The signal SIGa" that has been output from the temporary storage unit 29 and the video signal SIG are input at the timing at which the pixel selection signal DOTSEL attains the high level, and the comparison-result signal 55 changes from the low to the high level since the intensities of the two signals are different.

Similarly, in frame 44, the intensity of the video signal SIG entered at the timing at which the pixel selection signal DOTSEL attains the high level and the intensity of the video signal SIGa held during the period of frame 43 coincide, and therefore the comparison-result signal 55 changes from the high to the low level.

The comparison-result signal 55 is held in synch with the vertical synchronizing signal VSYNC, and a signal 56, which is the held result, is generated. The signal 56 attains the high level in a case where the polarity of the next frame (frame 44 when the basis is the comparison-result signal 55 of frame 43) is reversed, and assumes the low level in a case where the polarity of the next frame is not reversed.

The polarity selection signal POLSEL for selecting the polarity of the sequential analog video signal VSIG is generated by computing the exclusive-OR between the signal 56 and the signal 57 that switches between the high and low levels unconditionally every period of a subframe.

The polarity selection signal POLSEL is a signal which, when at the high level, selects the positive polarity for the polarity of the sequential analog video signal VSIG and, when at the low level, selects the negative polarity for the polarity of the sequential analog video signal VSIG. The selection involves comparing, between mutually adjacent frames, the intensity of the video signal SIG corresponding to the specific pixel a. If there is no change in intensity, then the selection made is to reverse polarity between mutually adjacent subframes within the frames and to not reverse polarity between mutually adjacent frames. If there is a change in intensity, then the selection made is to reverse polarity both between mutually adjacent frames and between mutually adjacent subframes within the frames.

The sequential analog video signal VSIG is a signal supplied from the polarity reversing unit 32 to pixels within the liquid crystal panel 1, and the polarity thereof reverses about the opposing potential Vcom every subframe period. This change in polarity is selected by the polarity selection signal POLSEL.

In a case where the video signal SIG is a digital signal, the polarity reversing unit 32 is provided with a digital/analog converter. The video signal SIG is input as a digital signal and is converted to an analog signal, positive or negative polarity of the signal about the opposing potential Vcom is selected by the polarity selection signal POLSEL and is adopted as the sequential analog video signal VSIG. In a case where the digital/analog converter has a function for controlling reversal of the polarity of the output, the polarity selection signal POLSEL may be used as a signal for controlling polarity. Further, two sets of digital/analog converters and analog switches may be used, a sequential analog video signal VSIG having positive polarity and a sequential analog video signal VSIG having negative polarity may be input to the sources of respective ones of the analog switches, and the polarity selection signal POLSEL may be input to gates of respective ones of analog switches with only one side being reversed such that only either one of the sequential analog video signals VSIG is output, thereby outputting either of the polarities.

Furthermore, in a case where the video signal SIG is an analog signal, polarity may be reversed using an operational amplifier based upon positive or negative polarity using the opposing potential Vcom as a reference voltage. In this case, a digital/analog converter will be unnecessary. However, in order to perform storage by the temporary storage unit 29 and the comparison operation by the comparing unit 31, it will be necessary to convert the analog signal to a digital signal using an analog/digital converter.

Next, the operation of the liquid crystal panel 1 and backlight 2 will be described with reference to FIGS. 7 and 8.

In the data driver 11 shown in FIG. 2, the data driver start signal DST enters from one of the serially connected shift registers 60 and is shifted from one shift register 60 to the next in synch with the data driver clock DCLK the frequency of which is equal to that of the dot clock signal DOTCLK that is externally input to the signal processor 3, thereby sequentially opening and closing the analog switches 61, which form pairs with respective ones of the data wiring traces D1, D2, D3, D4, D5, D6, in the low-level intervals. By opening and closing the analog switches 61, the sequential analog video signal VSIG, which is input to the analog switches 61 in parallel, is supplied sequentially to the data wiring traces D1, D2, D3, D4, D5, D6. In other words, the sequential analog video signal VSIG is supplied in the order of the six data wiring traces D1, D2, D3, D4, D5, D6 shown in FIG. 2.

Figure 8:
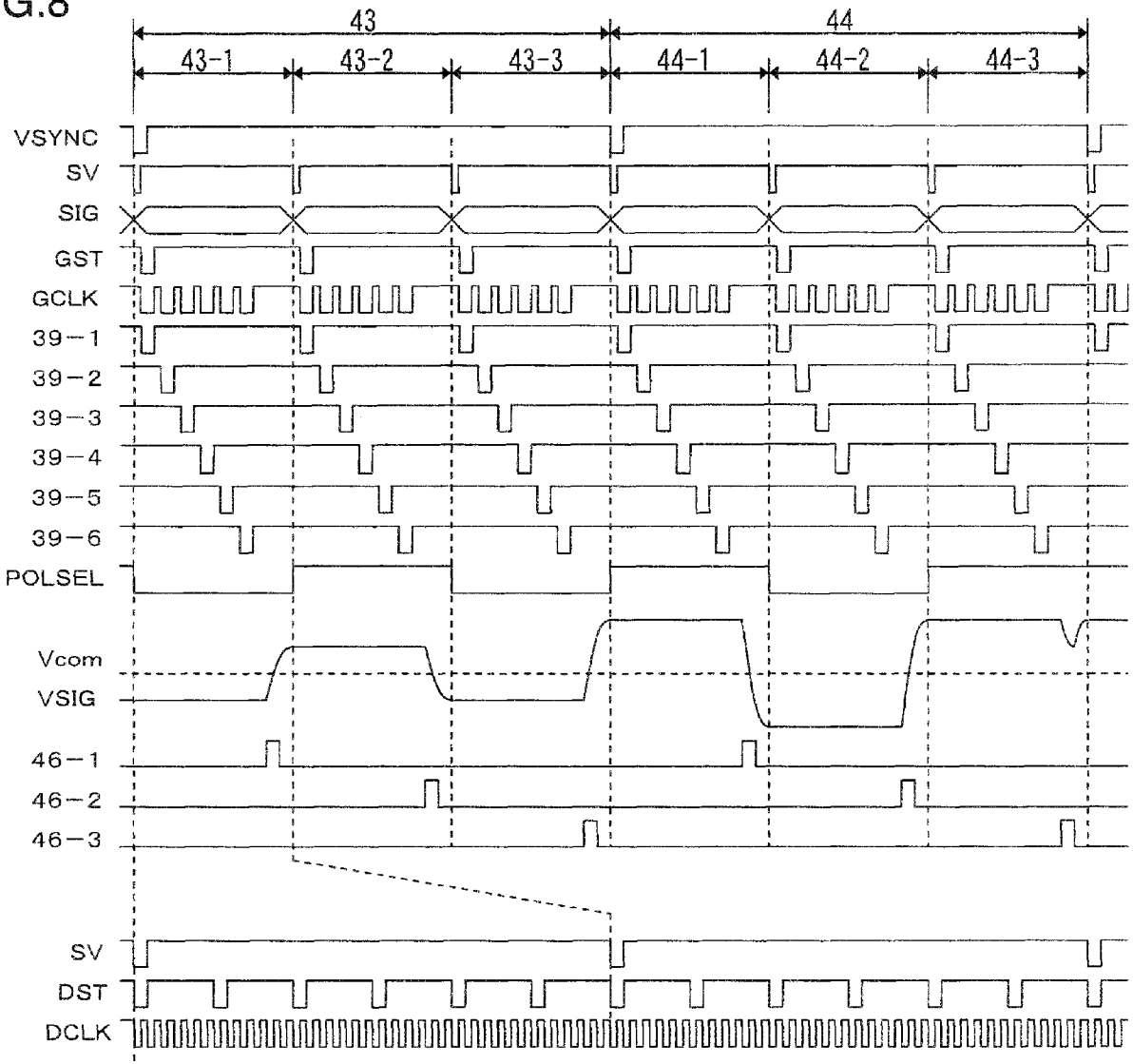
FIG. 8 is a timing chart representing operation of a liquid crystal panel and backlight according to the first exemplary embodiment.

Further, in the gate driver 12 shown in FIG. 2, in a manner similar to that of the data driver 11, the gate driver start signal GST is shifted from one serially connected shift register to the next in synch with the gate driver clock signal GCLK, thereby supplying the gate wiring trace G1 shown in FIG. 2 with a signal 39-1, which is shown in FIG. 8, for controlling the opening and closing of the gates. Further, a gate signal 39-2 for controlling the opening and closing of the gates is supplied to the gate wiring trace G2, a gate signal 39-3 for controlling the opening and closing of the gates is supplied to the gate wiring trace G3, a gate signal 39-4 for controlling the opening and closing of the gates is supplied to the gate wiring trace G4, a gate signal 39-5 for controlling the opening and closing of the gates is supplied to the gate wiring trace G5, and a gate signal 39-6 for controlling the opening and closing of the gates is supplied to the gate wiring trace G6. The gates of the TFTs in each row are opened in the low-level intervals shown in FIG. 8 and the potentials on the data wiring traces D1, D2, D3, D4, D5, D6 are written to and held in the pixels.

An R (red) firing signal 46-1, a G (green) firing signal 46-2 and a B (blue) firing signal 46-3 are the drive timings of the light-emitting unit 22 of backlight 2. When these signals are at the high level, they indicate a firing time period; when they are at the low level, they indicate extinguishment.

In the R (red) subframe 43-1 of frame 43, red monochromatic light is emitted when the R (red) firing signal 46-1 is at the high level, as a result of which red video constituting the color display of frame 43 is displayed in the interval of the R (red) subframe 43-1. In the G (green) subframe 43-2 of frame 43, green monochromatic light is emitted when the G (green)

firing signal 46-2 is at the high level, as a result of which green video constituting the color display of frame 43 is displayed in the interval of the G (green) subframe 43-2. In the B (blue) subframe 43-3 of frame 43, blue monochromatic light is emitted when the B (blue) firing signal 46-3 is at the high level, as a result of which blue video constituting the color display of frame 43 is displayed in the interval of the B (blue) subframe 43-3.

Similarly, frame 44 possesses intervals in which the R (red) firing signal 46-1, G (green) firing signal 46-2 and B (blue) firing signal 46-3 are at the high level in respective ones of the subframes in conformity with the composition of the color. In other words, in a case where the sequential analog video signal VSIG has finished being written to all pixels of the six rows and six columns in the subframes, a monochromatic video display is obtained in the subframes. Therefore, by also causing the light-emitting unit 22 to perform a monochromatic light emission corresponding thereto, the sequential analog video signal VSIG is displayed as color video.

In the description rendered above, an operation in which a specific pixel is compared between the G (green) subframes of mutually adjacent frames and the polarity of the sequential analog video signal VSIG is selected has been described. The reason for selecting G (green) is that it has the best viewability among the R (red), G (green), B (blue) monochromatic light. By changing the combination of logical operators of the pixel deciding unit 28, it is possible to deal with a case where the arrangement of the subframes is different, e.g., G (green), B (blue), R (red) or B (blue), G (green), R (red), or a case where the specific pixel is compared between R (red) subframes or B (blue) subframes.

Further, a plurality of the pixel deciding unit 28, temporary storage unit 29 and comparing unit 31 can be provided, video signals of a plurality of specific pixels can be compared irrespective of space and time, such as specific pixels in R (red) and G (green) subframes of the same frame or the pixel in the first row and first column and pixel in the sixth row and sixth column of the liquid crystal panel 1, and respective polarity selection signals generated as a result of the comparison can be subjected to, e.g., a logical OR operation, thereby raising the accuracy of the polarity selection. If only a very few pixels have changed and the entirety of a displayed image is perceived as not having changed when viewed by the human eye, a result closer to what is perceived by the human eye can be obtained by using this method for comparing the video signals of a plurality of pixels.

Further, in the foregoing exemplary embodiment, a comparison as to whether the video signals SIG and SIGa in mutually adjacent frames of a specific pixel coincide is performed. However, it is possible to compare only the higher order bits of the video signals. In such case the temporary storage unit and comparing unit can be reduced in scale. The coincidence and non-coincidence boundary conditions at the time of the comparison can be determined freely in a manner other than that described. For example, a non-coincidence decision can be rendered in a case where the difference between the compared signals is not less than a difference of one gray level.

[Second Exemplary Embodiment]

In the first exemplary embodiment, one frame is divided into three subframes in which monochromatic video of the respective colors R (red), G (green) and B (blue) is displayed. However, the number of divisions of one frame may be changed. A second exemplary embodiment of the present invention provides a liquid crystal display device in which one frame is divided into four subframes. Components identical with those of the first exemplary embodiment are designated by like reference characters and need not be described again.

Figure 9:
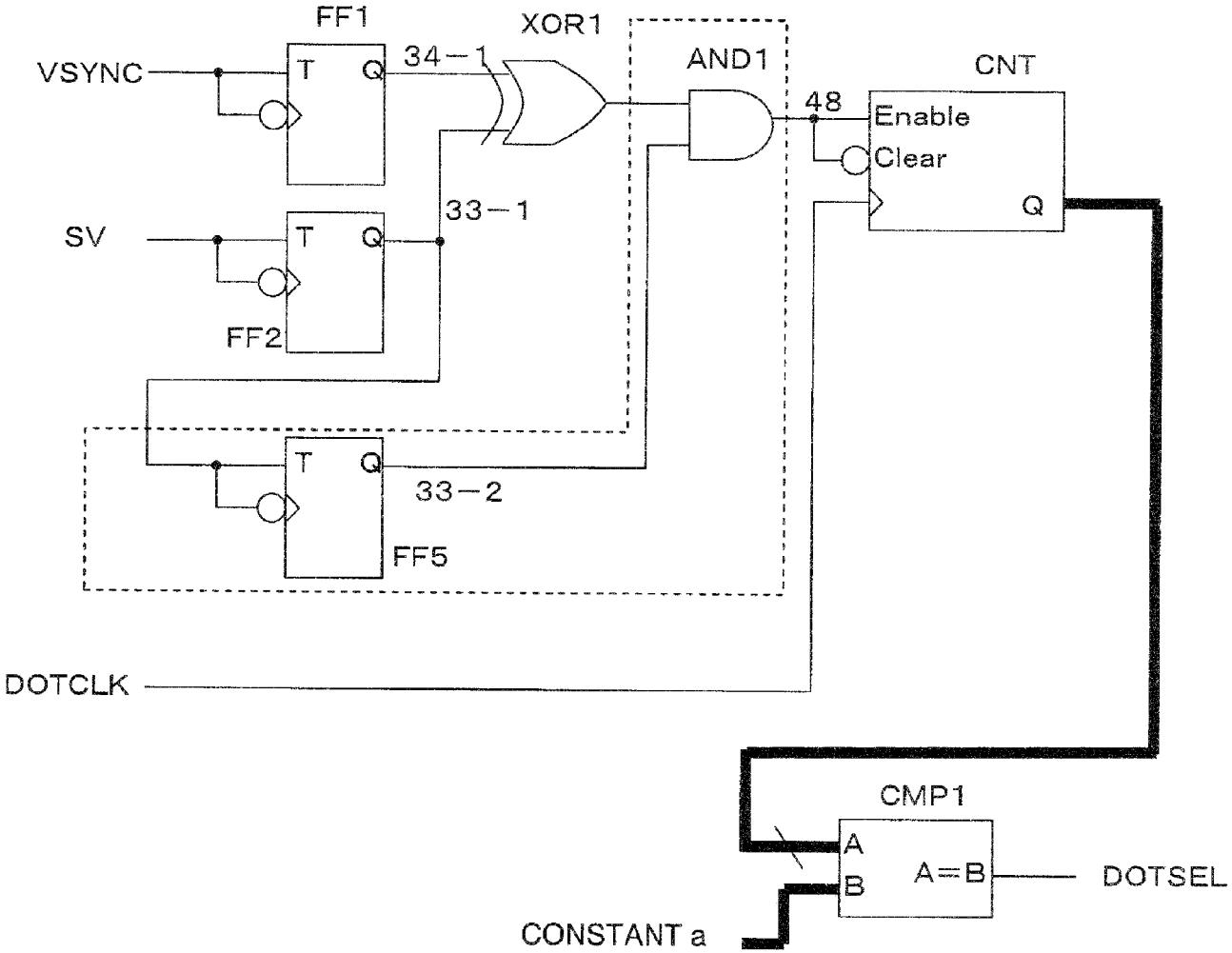
FIG. 9 is a circuit diagram or pixel deciding unit according to a second exemplary embodiment of the present invention.

FIG. 9 is a circuit diagram of a pixel deciding unit according to the second exemplary embodiment of the present invention. Components in FIG. 9 identical with those of FIG. 4 are designated by like reference characters. The pixel deciding unit 28 shown in FIG. 9 is obtained by adding a flip-flop FF5 and a 2-input AND gate AND1 to the arrangement of FIG. 4. The flip-flop FF5 receives the signal 33-1, which switches between high and low every subframe period, as an input and generates and outputs a signal 33-2 that switches between high and low every two subframe periods. The AND gate AND1 receives the output of the exclusive-OR gate XOR1 and the signal 32-2 as inputs and generates the signal 48 that attains the high level only in the time period of a G' (second green) subframe.

Figure 10:
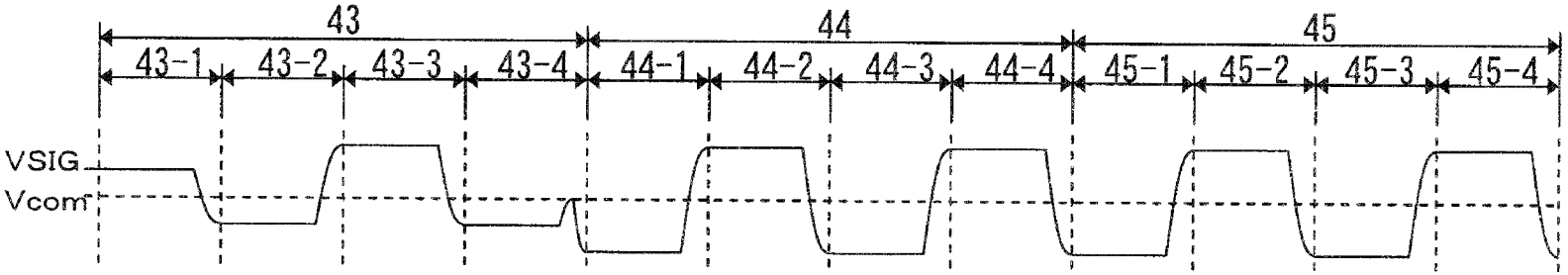
FIG. 10 is a timing chart representing operation of the liquid crystal display device according to the second exemplary embodiment.

FIG. 10 is a timing chart based upon the driving method for the second exemplary embodiment of the present invention. FIG. 10 differs from FIG. 6 of the first exemplary embodiment in that G' (second green) subframes (43-4, 44-4, 45-4) are added to respective ones of the frames. In the G' (second green) subframe, the sequential analog video signal VSIG, which has an intensity the same as that in the G (first green) subframe, is being written to the pixel. In other words, the G (green) monochromatic video is displayed twice in one frame. Operation in other respects is the same as in FIG. 6 of the first exemplary embodiment. The polarity of the sequential analog video signal VSIG is reversed unconditionally in units of the mutually adjacent subframes into which the frames have been divided, and the polarity of the sequential analog video signal VSIG is selectively reversed or not reversed in units of the mutually adjacent frames.

Figure 11:
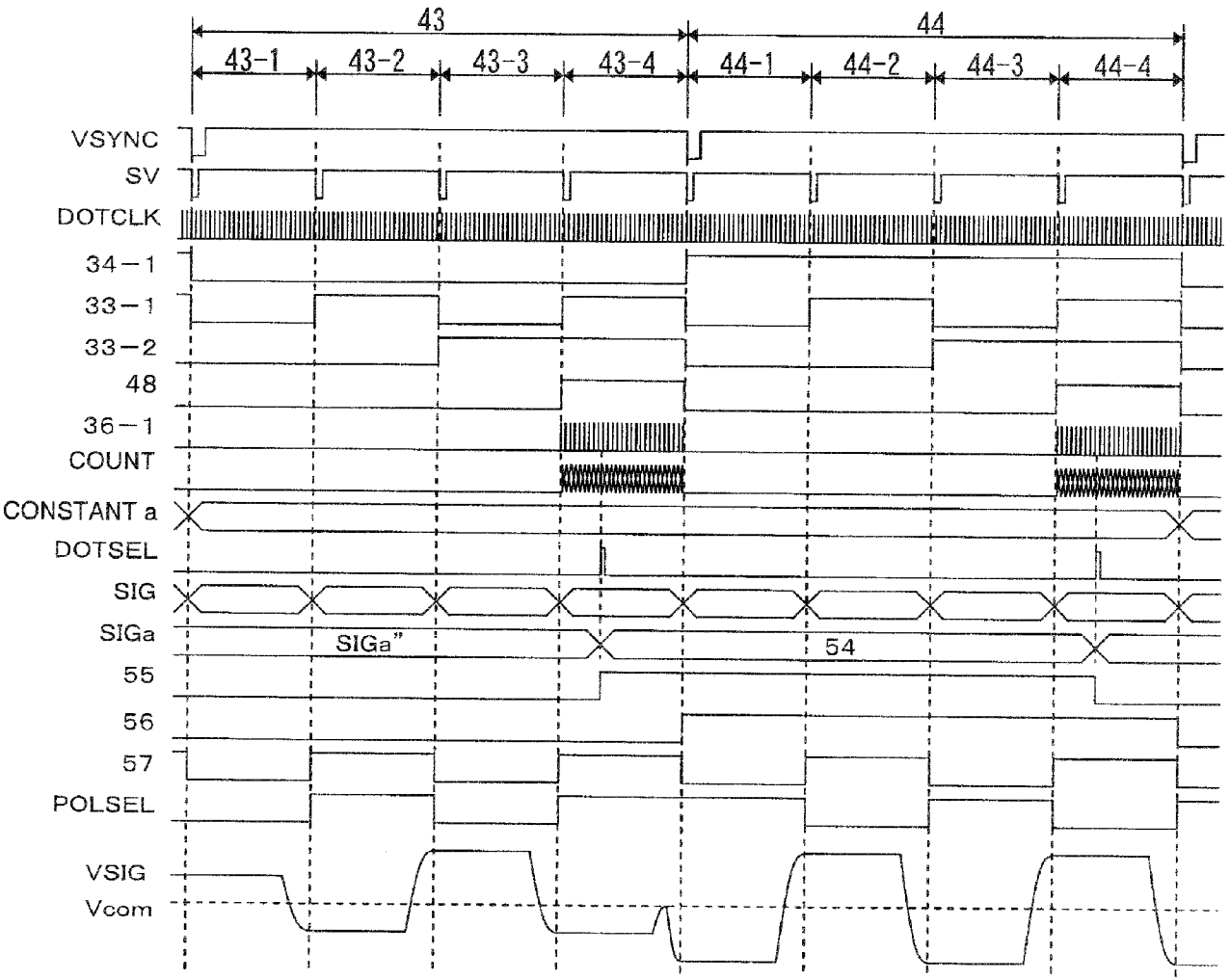
FIG. 11 is a timing chart representing operation of a signal processor according to the second exemplary embodiment.

FIG. 11 is a timing chart illustrating the operation of the signal processor according to the second exemplary embodiment. The operation shown in FIG. 11 is also substantially the same as that described using FIG. 7 of the first exemplary embodiment; what differs is that the period over which the specific pixel a is selected is made the G' (second green) subframe in all frames. In the pixel deciding unit, the dot clock signal DOTCLK is counted during the time that the signal 48, which represents the G' (second green) subframe, is at the high level, and the pixel selection signal DOTSEL, which attains the high level only in the time period of the video signal SIG that corresponds to the specific pixel, is generated.

Figure 12:
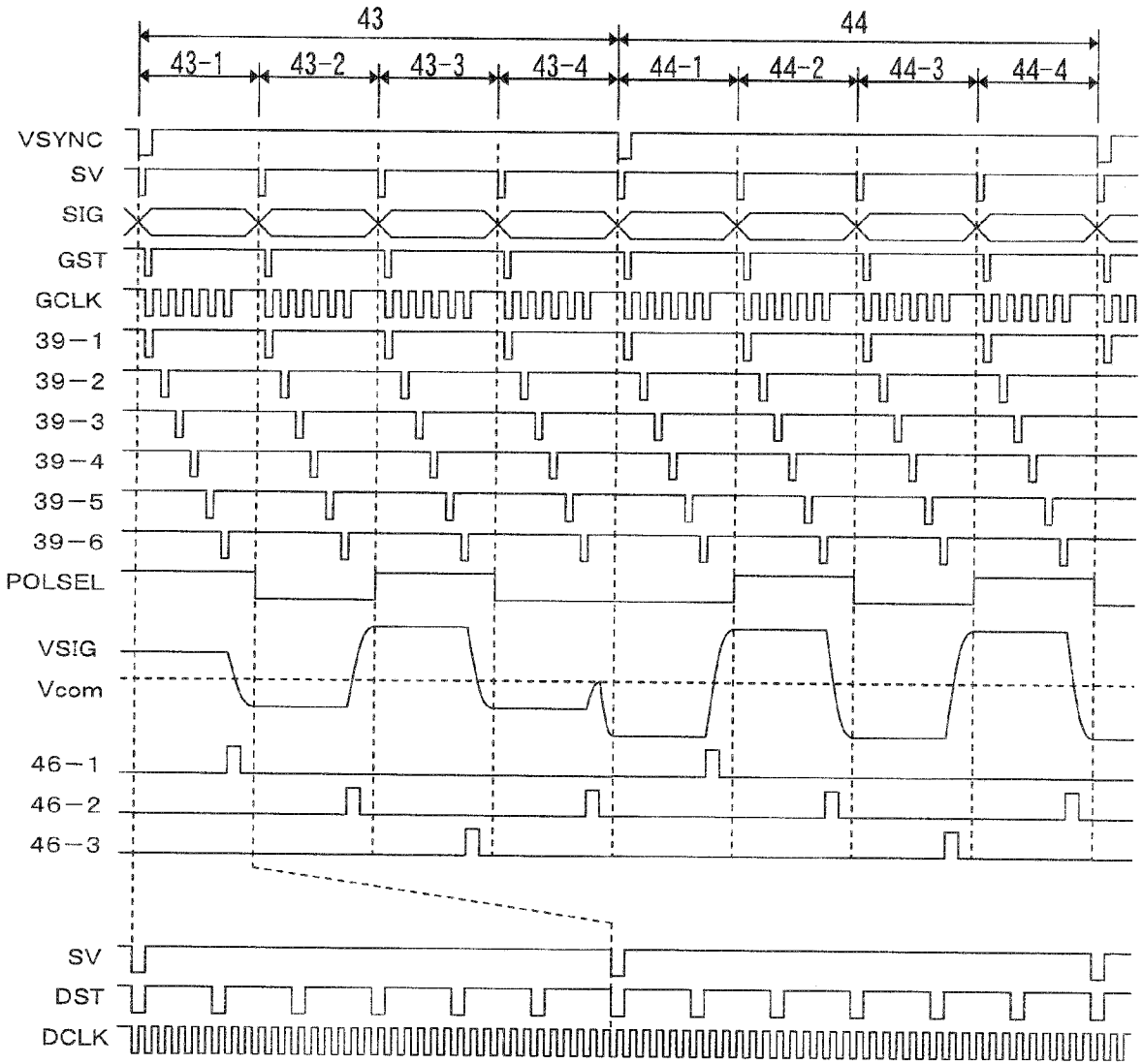
FIG. 12 is a timing chart representing operation of a liquid crystal panel and backlight according to the second exemplary embodiment.
Figure 13:
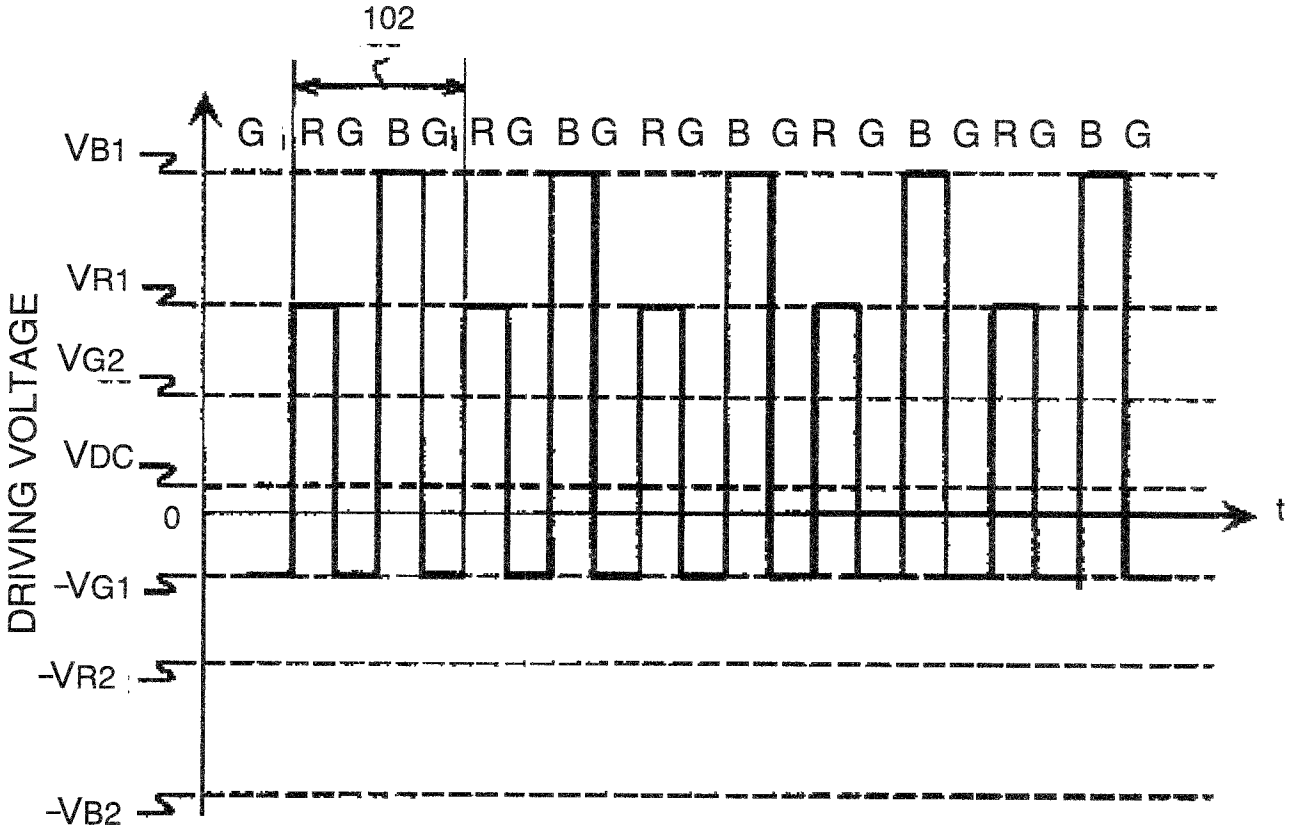
FIG. 13 is a diagram representing a temporal change in driving voltage in a conventional method for driving a liquid crystal display.

Further, the operation of the liquid crystal panel 1 and backlight 2 shown in FIG. 12 also is substantially the same as that of FIG. 8 of the first exemplary embodiment; what differs is that the signal 46-2 indicating light emission of green monochromatic light when at the high level attains the high level twice in one frame period. In other words, green monochromatic video is displayed also in the G' (second green) subframe.

In this exemplary embodiment, a frame is composed of four subframes for displaying monochromatic video of the colors R (red), G (green), B (blue) and G' (second green) along the time axis. As a result, time periods over which G (green) monochromatic video is displayed within each frame are greater than time periods over which R (red) and B (blue) are displayed. The reason for this is that within the range of visible light rays capable of being perceived by the human eye, color becomes white in a case where the intensities of monochromatic light are in a ratio of 6:3:1 in terms of the colors green, red and blue, respectively. Accordingly, effects similar to those of the first exemplary embodiment are attained by using the driving method for the second exemplary embodiment. Furthermore, by enlarging the proportion of the G (green) display period within one frame, white luminance of the frame is heightened and display quality can be improved. Further, when a green monochromatic image is displayed twice in one frame, the frequency of the green subframe becomes double that of the other colors. With regard to human perceptivity, the color green is twice as perceptible as the other two colors. Consequently, if the green subframe frequency doubles, there is reduced likelihood of the "color break-up" phenomenon, in which a color changeover is sensed by the observer. Accordingly, a color field sequential display with little color break-up is realized and display quality is improved.

It should be noted that white luminance of a frame may be heightened by adding on a W (white) subframe, which displays black-and-white monochrome video, rather than the G' (green) subframe, so that one frame will be composed of R (red), G (green), B (blue) and W (white) subframes. In this case, a W (white) light-emitting unit may be added on, or W (white) light may be obtained by emitting R (red), G (green) and B (blue) light simultaneously at the ratio of intensities mentioned above. White light is light comprising a plurality of colors. Therefore, in a case where there has been a changeover from a certain color to white or from white to a certain color, there is no color change in relation to the certain color and "color break-up", therefore, is recognized less often. As a result, there is little color break-up and display quality is improved.

In the first and second exemplary embodiments, polarity is selected by comparing video signals of a specific pixel. However, it is also possible to reverse polarity at the timing at which there is a change in the luminance of the backlight, which is a planar light source, thereby enabling a display that is free of flicker even though polarity is reversed. Further, it is possible to obtain a flicker-free display even if a polarity reversal is applied to only a portion of a display rather than the entire display.

Though the present invention has been described in accordance with the foregoing exemplary embodiments, the invention is not limited to these exemplary embodiments and it goes without saying that the invention covers various modifications and changes that would be obvious to those skilled in the art within the scope of the claims.

It should be noted that other objects, features and aspects of the present invention will become apparent in the entire disclosure and that modifications may be done without departing the gist and scope of the present invention as disclosed herein and claimed as appended herewith.

Also it should be noted that any combination of the disclosed and/or claimed elements, matters and/or items may fall under the modifications aforementioned.

What is claimed is:

1. A color field-sequential liquid crystal display device comprising:

a liquid crystal panel;

a planar light-source unit for emitting light toward said liquid crystal panel; and a signal processor connected to said liquid crystal panel and to said planar light-source unit;

wherein said signal processing includes:

a comparing unit that compares whether a difference in gray levels between gray-level signals of video signals located at the same time or spatial position from the beginning of said subframe among the subframes of the same color in each frame of two mutually adjacent video frames is not less than a prescribed value; and a polarity reversing unit that makes potentials of video signals in mutually adjacent subframes within the same frame go up and down to a prescribed potential, reversing all of the video signals of the one frame by centering on the prescribed potential, and outputting all of the video signals of the one frame to said liquid crystal panel in a case where the difference in gray levels is not less than the prescribed value, and outputting all of the video signals of the one frame without change to said liquid crystal panel in a case where the difference in gray levels is less than the prescribed value based upon the result of the comparison by said comparing unit.

2. The device according to claim 1, wherein the video signals compared by said comparing unit are signals corresponding to a prescribed plurality of pixels in said liquid crystal panel.

3. A method for driving a color field-sequential liquid crystal display device having a liquid crystal panel, a planar light-source unit for emitting light toward the liquid crystal panel and a signal processor connected to the liquid crystal panel and to the planar light-source unit, wherein the method comprises:

making potential of video signals between mutually adjacent subframes in the same video frame to go up and down to a prescribed potential;

comparing video signals corresponding to a prescribed one or a plurality of pixels of the liquid crystal display panel between subframes of the same color in two mutually adjacent video frames, thereby detecting a change in the video signals in the prescribed one or plurality of pixels between subframes;

deciding whether or not to reverse the polarities of all video signals of one frame based upon the result of detection;

reversing all of the video signals of the one frame by centering on the prescribed potential and outputting all of the video signals of the one frame to said liquid crystal panel in a case where the result of detection indicates a change that is not less than the prescribed amount; and outputting all of the video signals of the one frame without change to said liquid crystal panel in a case where the result of detection indicates a change that is less than the prescribed amount.

4. The method according to claim 3, wherein in said comparing video signals, determination is performed whether a difference in gray levels between gray-level signals of video signals located at the same time or spatial position from the beginning of the subframe among the subframes of the same color is not less than a prescribed value.

5. The method according to claim 3, wherein the video signals compared by said comparing are signals corresponding to a prescribed plurality of pixels in said liquid crystal panel.

* * * * *